US005524834A

United States Patent [19]

Bogucki-Land

[11] Patent Number: 5,524,834

[45] Date of Patent: Jun. 11, 1996

[54] ARRANGEMENT FOR THE CONTROL OF THREAD TENSION IN A THREAD SPOOL CREEL

[75] Inventor: Bogdan Bogucki-Land, Offenbach am Main, Germany

[73] Assignee: Karl Mayer Textilmaschinenfabrik Gmbh, Obertshausen, Germany

[21] Appl. No.: 263,787

[22] Filed: Jun. 22, 1994

[30] Foreign Application Priority Data

Jun. 26, 1993 [DE] Germany ..... 43 21 318.9

[51] Int. Cl.[6] ..... B65H 23/06; B65H 59/02

[52] U.S. Cl. ..... 242/421.8; 242/147 M; 242/156.2; 242/421.5; 242/421.9; 242/422.2; 242/422.4

[58] Field of Search ..... 242/421.8, 421.9, 242/421.5, 422.2, 422.4, 422.8, 156.2, 147 M

[56] References Cited

U.S. PATENT DOCUMENTS

| | | | |
|---|---|---|---|
| 2,879,011 | 3/1959 | Nelson | 242/422.4 |
| 3,223,352 | 12/1965 | Fuller et al. | 242/156.2 |
| 3,595,529 | 7/1971 | Stull | 242/156.2 |
| 3,648,948 | 3/1972 | Level | 242/421.8 X |
| 3,731,889 | 5/1973 | Alexeff | 242/156.2 |
| 3,862,724 | 1/1975 | Johnson et al. | 242/422.2 |
| 3,963,191 | 6/1976 | Goodley | 242/422.2 |
| 4,139,165 | 2/1979 | Dyck | 242/422.4 X |
| 4,199,118 | 4/1980 | Tero et al. | 242/422.2 X |
| 4,327,873 | 5/1982 | Juppet et al. | 242/422.2 |
| 4,709,872 | 12/1987 | Hammer et al. | 242/422.2 X |
| 4,958,780 | 9/1990 | Bruenn et al. | 242/422.2 |

FOREIGN PATENT DOCUMENTS

| | | | |
|---|---|---|---|
| 2380973 | 10/1978 | France | 242/156.2 |
| 883727 | 7/1953 | Germany . | |
| 1918161 | 10/1970 | Germany . | |
| 8025217 | 3/1981 | Germany . | |
| 358043 | 10/1961 | Switzerland . | |
| 1071190 | 8/1964 | United Kingdom . | |

*Primary Examiner*—William Stryjewski
*Attorney, Agent, or Firm*—Omri M. Behr; Matthew J. McDonald

[57] ABSTRACT

The arrangement controls thread tension in a spool creel with a brake rotor (brake drum 4) for each spool holder (1). A braking element (brake band 5) operates therewith and is biasable by a tensioning lever (8) which takes an angular setting dependent upon the thread tension and the force of gravity. A fluid pressure activated biasing arrangement 13 influences the tensioning lever 8 at each spool holder 1. The fluid pressure is commonly adjustable for all of the biasing arrangements 13. In this manner a general changing of the thread tension can be combined with control of individual thread tension.

11 Claims, 2 Drawing Sheets

ARRANGEMENT FOR THE CONTROL OF THREAD TENSION IN A THREAD SPOOL CREEL

BACKGROUND OF THE INVENTION

1. Field of the Invention

The present invention is directed to an arrangement for the control of thread tension in a spool creel having several spool holders each provided with a brake rotor working with a braking element that is adjustable by a tensioning lever carrying a roller; wherein the roller and lever is biased by the departing thread to take up an angular position dependent upon thread tension and net weight.

Such arrangements which are presently in the marketplace have the advantage that the force exercised by the braking band automatically decreases as the wind diameter of each spool is reduced. The weight distribution on the tensioning lever is predetermined and thus also the thread tension exercised by the creel spools on the threads.

2. Description of Related Art

The creel arrangements presently on the marketplace (compare for example, DE OS 19 18 161) have the advantage that the braking force exercised by the braking arrangement is automatically decreased when the wind diameter on the spools is reduced. The weight distribution on the tensioning level is predetermined and thus also the thread tension exercised upon the threads taken from the creel.

From DE PS 88 3 727, it is known to provide electromagnetic brakes to all spool holders to drive all magnets in parallel switching and to alter the activation current by a common setting arrangement. In this way, the entire tension from the various creels can be changed during operation and, at switch-off, a rapid braking action can be obtained by raising the braking force. This gives rise however to a loss of individual control of the tension of the individual spools.

It is also known to provide pneumatic biasing arrangements to thread brakes (DE GM 80 25 217) in which the biasing for a plurality of thread brakes in a spool creel can be centrally set and controlled.

Swiss Patent 358 043 describes a thread brake in which a braking platelet acts upon the threads by means of a pneumatic cylinder piston assembly whose pressure is set from a central control point.

British Patent 1 071 190 discloses the provision of a brake shoe to a spool which under the influence of a pressure means, can be forced against a rotating braking surface.

SUMMARY OF THE INVENTION

An object of the present invention is providing an arrangement for the control of thread tension in a spool creel in which the thread tension for the entire array as well as for individual spool holders can be achieved.

In accordance with the illustrative embodiments demonstrating features and advantages of the present invention, there is provided an arrangement for controlling tension of threads in a spool creel having a plurality of spool holders. This arrangement has a plurality of controllers. These controllers are simultaneously settable by fluid pressure. Each of the controllers are coupled to a different corresponding one of the spool holders. Each of the controllers has a brake rotor and an adjustable, tension responsive, braking element coupled to the brake rotor. The arrangement also has a tensioning lever coupled to the braking element for biasing it. The tensioning lever has a roller adapted to engage and be biased by the threads. This tensioning lever is operable to occupy an angular position dependent upon thread tension and weight. Also included is a biasing arrangement adapted to be activated by fluid pressure and connected to the tensioning lever, each of the tension levers being simultaneously settable by the fluid pressure.

By employing such apparatus an improved tension control is achieved in a creel arrangement wherein each spool holder is provided with a fluid pressure sensitive biasing arrangement, which influences the tensioning lever and wherein the fluid pressure is controllable in common for all the biasing arrangements.

The force generated by the preferred biasing arrangement operates in addition to the weight force on the tensioning lever, whereby the thread tension is also altered. This change can be centrally set so that the thread tension can be determined for the entire creel.

When the warping machine served by the creel is shut off, the braking force throughout the entire creel can be increased so that a quick braking action is possible. Since the biasing arrangement operates by fluid pressure, it can influence the tensioning lever without hindering the swinging action of the tension lever necessary for the control procedure.

Preferably, the biasing arrangement is formed by a piston/cylinder assembly. Piston cylinder arrangements can, by maintenance of the fluid pressure, readily follow the swinging movement of the tensioning lever by changing their length. Also using a pneumatic drive at the same time prevents contamination of the threads by the pressurizing substance. Each spool holder need only be connected to a conduit providing the necessary pneumatic pressure.

Preferably, the tensioning lever in the total working area subtends an angle A to the horizontal plane of more than 45°. Also the working elevation angle of the biasing arrangement attached to the tensioning lever should preferably subtend an angle B of less than 45°. In particular, it is preferred that the angle A should be in the range of 60° to 80° and the angle B in the range of 30° to 40°. In this manner, the force component exercised by the biasing arrangement on the tensioning lever is substantially equal in the entire control range since the angle B is minimally altered.

In a preferred modification the biasing arrangement furthermore operates on a brake shoe, which is provided to a further rotating braking surface. This brake shoe is applied only under higher fluid pressures to a further braking surface, which can cause the braking to occur rather rapidly at the shut down of the warping machine.

Advantageously, the braking shoe can be held by the tensioning lever. This gives rise to a rather simple mode of construction with few additional parts. Furthermore, the tensioning lever ensures that the braking shoe on restart of the warping machine is removed from contact with the further braking surface and therefore no locking can occur.

The brake rotor may advantageously be a brake drum wherein the braking element is a braking band contactable therewith and tensionable by the tensioning lever.

In a preferred alternative, the brake rotor is a braking disc of electro-conductive material and the braking element is a magnetic system, which is displaceable by the tensioning lever into a position more or less covering the braking disc. In particular the magnetic system can comprise a permanent magnet adjacent one of a pair of legs straddling the braking disc.

BRIEF DESCRIPTION OF THE DRAWINGS

The above brief description as well as other objects, features and advantages of the present invention may be illustrated by the preferred embodiments as set forth in the drawings described below, wherein.

DETAILED DESCRIPTION OF THE PREFERRED EMBODIMENTS

Figure 1:
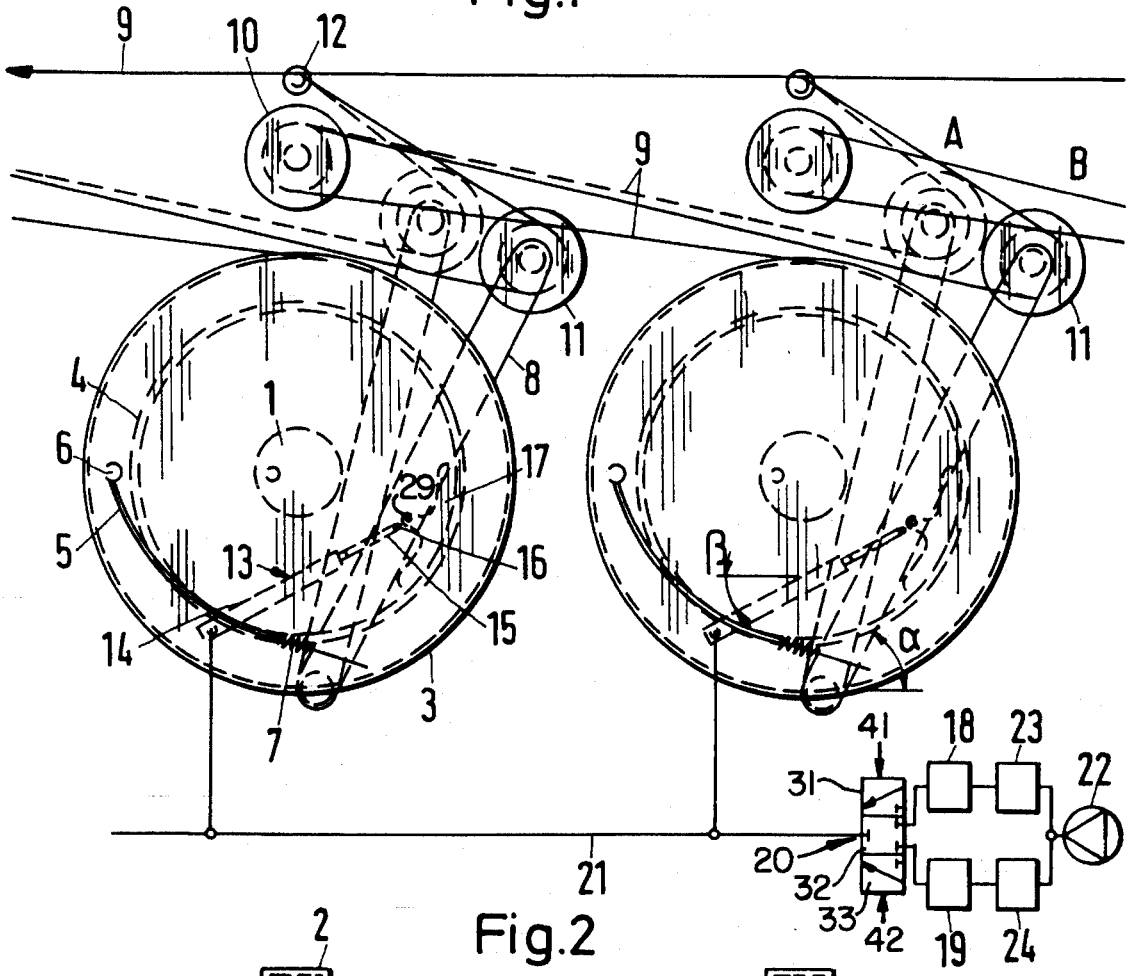
FIG. 1 is a schematic, side elevational view of two spool holders having a tension controlling arrangement, in accordance with principles of the present invention.

A spool holder 1 is attached to the creel by socket 2. Mounted on holder 1 is a rotatable spool 3 wound with thread. In the operating example, a bolt 25 serves to connect spool 3 to the braking drum 4 to prevent relative rotation. Thus spool 3 is non-rotatably connected with braking drum 4, which has braking surfaces on an inside circumference and an outside circumference thereof.

A braking band 5 lies on the outer circumference of drum 4. Drum 4 and the equipment described hereinafter for controlling the braking band 5 are referred to as a controller. The braking band 5 is connected at one end to an immovable pin 6 and at the other end via spring 7 to the fixedly supported tensioning lever 8.

The threads 9 taken from the circumference of the spool 3 are first led over fixedly supported roller 10 and then looped around a further roller 11 which is attached to the free end of tensioning lever 8 and finally via eyelet 12 is led to an adjacent machine, for example, a warping machine.

The mass of the tensioning lever 8 in combination with the portions attached thereto exercise a clockwise turning moment thereon. A turning moment in the opposite direction is exercised by the tension of the thread 9. If the thread tension is too great, the tensioning lever moves from position B to position A, whereby the braking force exercised by the braking band 5 is diminished. The spool 3 can thus rotate more rapidly, which reduces thread tension so tensioning lever 8 again moves from position A toward the direction of position B. This eventually brings lever 8 to an equilibrium setting where the thread is taken off at exactly the desired tension.

A pneumatic biasing arrangement 13 is connected to tensioning lever 8. This comprises a fixedly supported cylinder 14 and a piston 15 (a piston and cylinder assembly) which is connected to the tensioning lever 8 by means of a hinge pin 16. While tensioning lever 8 is oriented at angle A (illustrated with the Greek reference character, alpha) of 60° to 80° from the horizontal, the biasing arrangement 13 is oriented at an angle B (illustrated with the Greek reference character, beta) of 30° to 40° from the horizontal in the thread direction.

Furthermore, hingedly attached to tensioning lever 8 via pin 29, is brake shoe 17 (shown in phantom), which operates in conjunction with a braking surface on the inner circumference of braking drum 4. When the tensioning lever 8 is swung beyond position B, an additional braking effect is brought into play, since pin 29 brings the braking shoe 17 into contact with the internal braking surface of drum 4.

One of two pressure means 18 and 19 (shown herein as plenums) can be selected via a switching valve 20 for connection to a conduit system 21. System 21 is operatively connected to all the biasing arrangements 13 in the entire creel. A pressure pump 22 pressurizes the first pressure means 18 by means of a pressure regulator 23 to a predetermined working magnitude of pressure. Second pressure means 19 is likewise pressurized through pressure regulator 24 to a predetermined braking magnitude of pressure. The working magnitude of pressure may lie, for example, in the order or magnitude of two bars in order to support the operation of the mass of tensioning lever 8. Thus when the working pressure of conduit system 21 is increased, the thread tension in the entire creel is raised.

By altering the working pressure by assistance of regulator 23, the thread tension can be adjusted as desired. The braking pressure may, for example, lie in the range of eight bar so that the braking shoe 17 remains in contact with the appropriate braking surface and thus a rapid braking of the spools on the creel can occur.

Switching valve system 30 has connecting sections 31 and 33 and blocking chamber 32, which does not permit passage of fluid. When the adjacent machine is operating, a signal is sent via input means 41 to make section 31 operative and connect pressure means 18 to conduit system 21. When the said machine is shut off, a signal is sent via input means 42 to make section 33 operative and connect pressure means 19 to conduit system 21, thus driving the major braking system of shoe 17 to the internal braking surface of drum 4.

There is also a plurality of further possibilities. The tensioning lever 8 can be biased by an additional weight (not shown). This weight can be changed. The weight can also be attached to another lever arm (not shown) angularly displaced relative to the tensioning lever.

Figure 2:
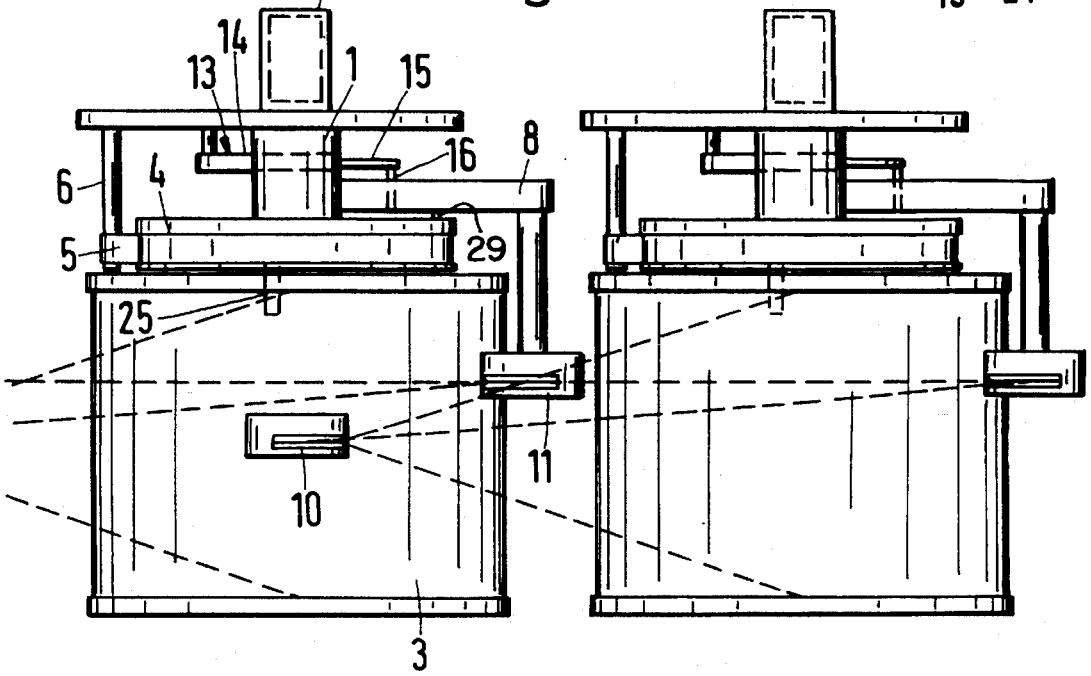
FIG. 2 is a plan view of the arrangement of FIG. 1.
Figure 3:
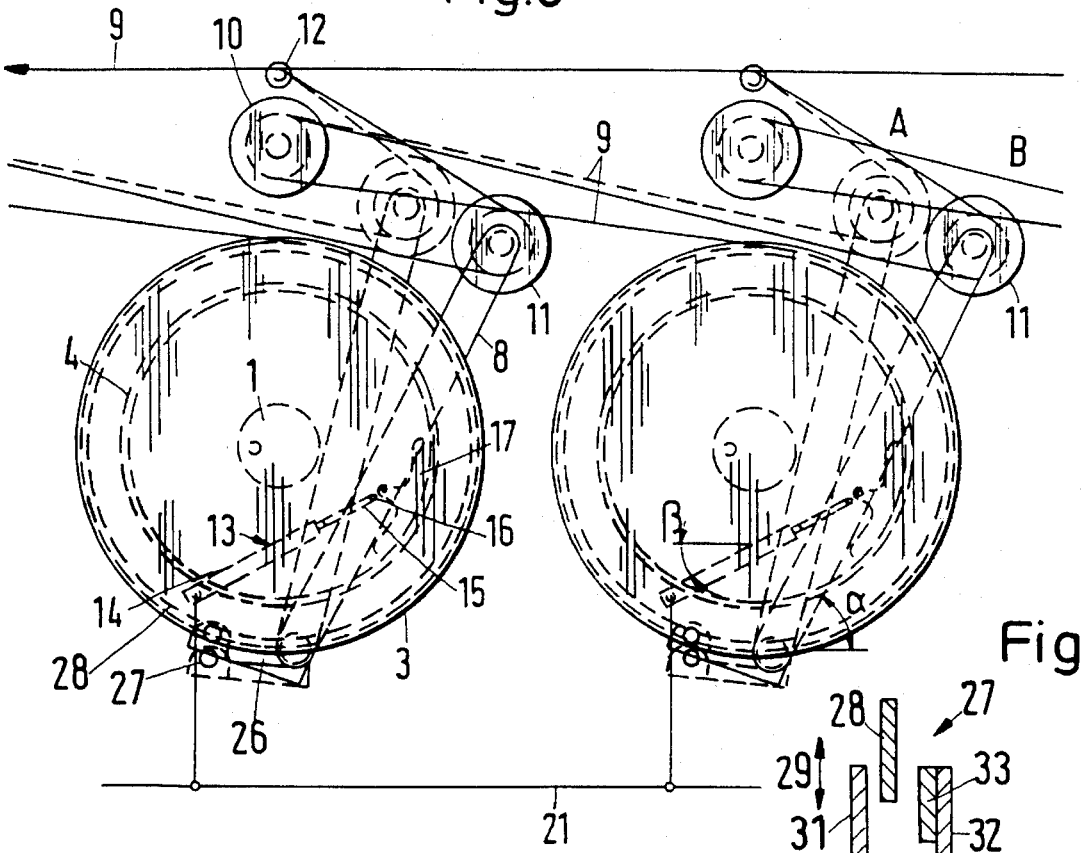
FIG. 3 is a schematic view of an embodiment that is an alternate of the control arrangement shown in FIG. 1.
Figure 5:
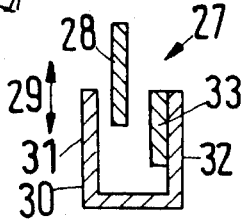
FIG. 5 is a sectional view of the magnetic system of the braking arrangement of FIG. 3.
Figure 4:
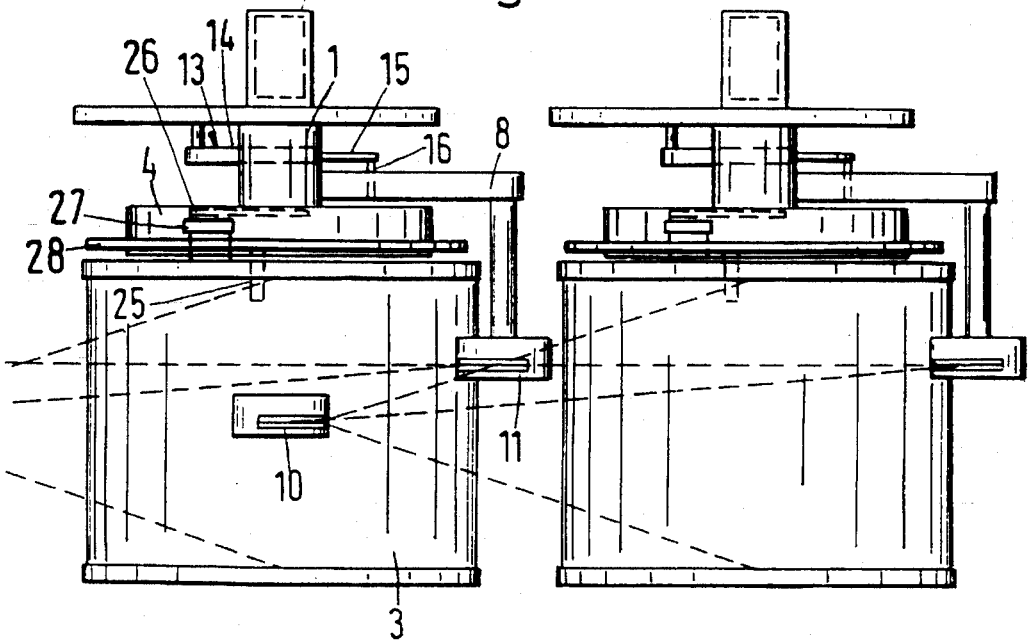
FIG. 4 is a plan view of the arrangement of FIG. 3.

The alternate embodiment of FIGS. 3 and 4 corresponds substantially to that illustrated in FIGS. 1 and 2. Identical parts have the same reference numbers throughout the Figures. FIG. 5 is a detailed schematic view of the magnetic system of FIGS. 3 and 4.

An important difference in this alternate embodiment is the replacement of the friction brake (braking band 5 of FIGS. 1 and 2) with an electromagnetic brake. For this purpose, tensioning lever 8 is rigidly connected with a transverse lever arm 26, which carries at its free end a magnetic system 27. This system 27 surrounds braking disc 28, which is attached to brake drum 4 and is made from electrically conductive material, suitably aluminum. When the tensioning lever 8 is swung, the brake disc 28 covers the braking system 27 more or less (see arrow 29).

The magnetic system 27 comprises a U-shaped carrier 30 with two legs 31 and 32. Leg 32 carries a permanent magnet 33. Lever arm 26 is shown in two settings. In the completely engaged setting (lined in full), system 27 exercises a stronger braking force, but in the retracted setting (lined in phantom), system 27 exercises a lesser braking force.

The magnetic system 27 brakes by generating eddy currents in braking disc 28. The more disc 28 is covered by system 27, the greater the braking effect. Also with this construction, by the activation of the biasing arrangements of all the braking arrangements the thread tension can be globally altered, while by pressing the brake shoe 17 to the brake drum 14 a rapid braking can be obtained.

I claim:

1. Arrangement for controlling tension of threads in a spool creel having a plurality of spool holders, said arrangement having a plurality of controllers, said controllers being simultaneously settable by fluid pressure, each of said controllers being coupled to a different corresponding one of said spool holders, each of said controllers comprising:

a brake rotor;

an adjustable, tension responsive, braking element coupled to said brake rotor;

a tensioning lever coupled to said braking element for biasing said braking element, said tensioning lever having a roller adapted to engage and be biased by the thread, said tensioning lever being operable to occupy an angular position dependent upon thread tension and weight; and a biasing arrangement adapted to be activated by fluid pressure and connected to the tensioning lever, each of said tension levers being simultaneously settable by the fluid pressure, each biasing arrangement having a pneumatic piston and cylinder assembly attached to a respective one of said tensioning levers and connected to a common fluid pressure means, the tensioning lever during its operation making an upwardly directed angle A to a horizontal exceeding 45°, said tensioning lever having an upper end for supporting the roller, the piston and cylinder assembly during its operation making an upwardly directed angle B to the horizontal of less than 45°.

2. Arrangement in accordance with claim 1 wherein the angle A is in the range of 60°–80° and the angle B is in the range of 30°–40°.

3. Arrangement in accordance with claim 1 comprising:

a brake shoe coupled to and driveable by said biasing arrangement for providing a further rotating braking effect upon said brake rotor.

4. Arrangement in accordance with claim 3 wherein the brake shoe is attached to the tensioning lever.

5. Arrangement in accordance with claim 3 including means for providing the fluid pressure, comprising:

first pressure means for providing the fluid pressure at a working magnitude;

a second pressure means for providing the fluid pressure at a braking magnitude;

a common conduit system commonly leading to all the biasing arrangements; and a valve arrangement for selectively connecting the common conduit system to either the first or the second pressure means.

6. An arrangement in accordance with claim 3 wherein the brake rotor comprises a braking drum, the braking element comprising a braking band tensioned by the tensioning lever for engaging said braking drum.

7. An arrangement in accordance with claim 3 wherein the brake rotor comprises:

a braking disc of electrically conductive material, the braking element comprising:

a magnetic system coupled to and displaceable by the tensioning lever into a variable position covering the braking disc by a variable amount to vary braking force on said braking disc.

8. An arrangement in accordance with claim 7 wherein the magnetic system comprises:

two arms straddling the braking disc; and a permanent magnet mounted adjacent to one of said arms.

9. Arrangement in accordance with claim 1 including means for providing the fluid pressure, comprising:

first pressure means for providing the fluid pressure at a working magnitude;

a second pressure means for providing the fluid pressure at a braking magnitude;

a common conduit system commonly leading to all the biasing arrangements; and a valve arrangement for selectively connecting the common conduit system to either the first or the second pressure means.

10. An arrangement in accordance with claim 1 wherein the brake rotor comprises a braking drum, the braking element comprising a braking band tensioned by the tensioning lever for engaging said braking drum.

11. An arrangement in accordance with claim 1 wherein the brake rotor comprises:

a braking disc of electrically conductive material, the braking element comprising:

a magnetic system coupled to and displaceable by the tensioning lever into a variable position covering the braking disc by a variable amount to vary braking force on said braking disc.

* * * * *